US011319727B1

(12) United States Patent
Tobias

(10) Patent No.: US 11,319,727 B1
(45) Date of Patent: May 3, 2022

(54) APPARATUS FOR SECURING A DEVICE

(71) Applicant: Marc Tobias, Pittsburgh, PA (US)

(72) Inventor: Marc Tobias, Pittsburgh, PA (US)

( * ) Notice: Subject to any disclaimer, the term of this patent is extended or adjusted under 35 U.S.C. 154(b) by 0 days.

(21) Appl. No.: 17/233,704

(22) Filed: Apr. 19, 2021

Related U.S. Application Data

(60) Provisional application No. 63/024,562, filed on May 14, 2020.

(51) Int. Cl.
*E05B 47/00* (2006.01)

(52) U.S. Cl.
CPC .. *E05B 47/0012* (2013.01); *E05B 2047/0058* (2013.01); *E05B 2047/0067* (2013.01); *E05B 2047/0082* (2013.01); *E05B 2047/0094* (2013.01)

(58) Field of Classification Search
CPC ..... E05B 47/0012; E05B 2047/0058; E05B 2047/0067; E05B 2047/0082; E05B 2047/0094; E05B 73/0005; E05B 73/0082; E05B 2047/0084
USPC ..... 70/58
See application file for complete search history.

(56) References Cited

U.S. PATENT DOCUMENTS 5,381,685 A 1/1995 Carl
5,660,065 A * 8/1997 Edlund ..... E05B 47/0012 248/553
5,667,187 A 9/1997 Doman
6,305,656 B1 10/2001 Wemyss
6,389,853 B1 * 5/2002 Pate ..... E05B 45/005 340/432
6,552,650 B1 4/2003 Gokcebay
7,034,654 B2 4/2006 Forest
7,958,758 B2 6/2011 Trempala
8,122,746 B2 2/2012 Hyatt, Jr.
10,403,122 B2 9/2019 Fawcett
10,423,136 B2 9/2019 Davis
2005/0039502 A1 * 2/2005 Avganim ..... G06F 21/32 70/58
2007/0144225 A1 * 6/2007 Tamura ..... E05B 73/0082 70/58
2007/0229962 A1 10/2007 Mason, Jr.
(Continued)

FOREIGN PATENT DOCUMENTS

CA 2061455 8/1993
CA 2133743 10/1993

*Primary Examiner* — Lloyd A Gall
(74) *Attorney, Agent, or Firm* — Jeffrey A. Proehl; Woods, Fuller, Shultz & Smith, PC

(57) ABSTRACT

A system for securing a device having a case and a security feature integrated into the device. The system has a device security apparatus removably mountable on the device by agency of the security feature on the case of the device. The device security apparatus may include a base element configured to mount on the device by releasably engaging the security feature of the device, and may further include a securing element removably mounted on the base element. The securing element may include at least one of a plurality of modules configured to interchangeably mount on the base element. The plurality of modules may include a mechanical connection module configured to physically connect the device security apparatus to an object, and a monitoring module configured to monitor movement of the device security apparatus and any device connected to the device security apparatus.

19 Claims, 5 Drawing Sheets

(56) References Cited

U.S. PATENT DOCUMENTS

| | | | | |
|---|---|---|---|---|
| 2008/0001705 | A1* | 1/2008 | Kritt | G07F 7/0886 340/5.31 |
| 2013/0316114 | A1 | 11/2013 | Hwang | |
| 2014/0085773 | A1 | 3/2014 | Chermukhin | |
| 2014/0085788 | A1* | 3/2014 | Avganim | G06F 1/1656 361/679.01 |
| 2015/0242895 | A1 | 8/2015 | Brown | |
| 2016/0081212 | A1* | 3/2016 | Avganim | G06F 1/1656 361/679.57 |
| 2016/0201359 | A1* | 7/2016 | Berglund | G08B 13/1472 70/58 |
| 2016/0343224 | A1 | 11/2016 | Markwell | |
| 2016/0378140 | A1 | 12/2016 | Bergmann | |
| 2017/0312578 | A1 | 11/2017 | Tran | |

* cited by examiner

APPARATUS FOR SECURING A DEVICE

REFERENCE TO RELATED APPLICATIONS

This application claims the priority benefit of U.S. Provisional Patent Application No. 63/024,562, filed May 14, 2020, which is hereby incorporated by reference in its entirety.

BACKGROUND

Field

The present disclosure relates to electronic device security apparatus and more particularly pertains to a new apparatus for securing a device to provide security for the device through physical securement against movement and/or through monitoring of movement of the device and alerting when unauthorized movement is detected.

SUMMARY

The present disclosure relates to a system for securing a device which has a case and a security feature integrated into the device. The system may comprise a device security apparatus removably mountable on the device by means of the security feature on the case of the device. The device security apparatus may comprise a base element configured to mount on the device by releasably engaging the security feature of the device, and a securing element removably mounted on the base element. The securing element may include at least one of a plurality of modules configured to interchangeably mount on the base element. The plurality of modules may include a mechanical connection module configured to physically connect the device security apparatus to an object, and a monitoring module configured to monitor movement of the device security apparatus and any device connected to the device security apparatus.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
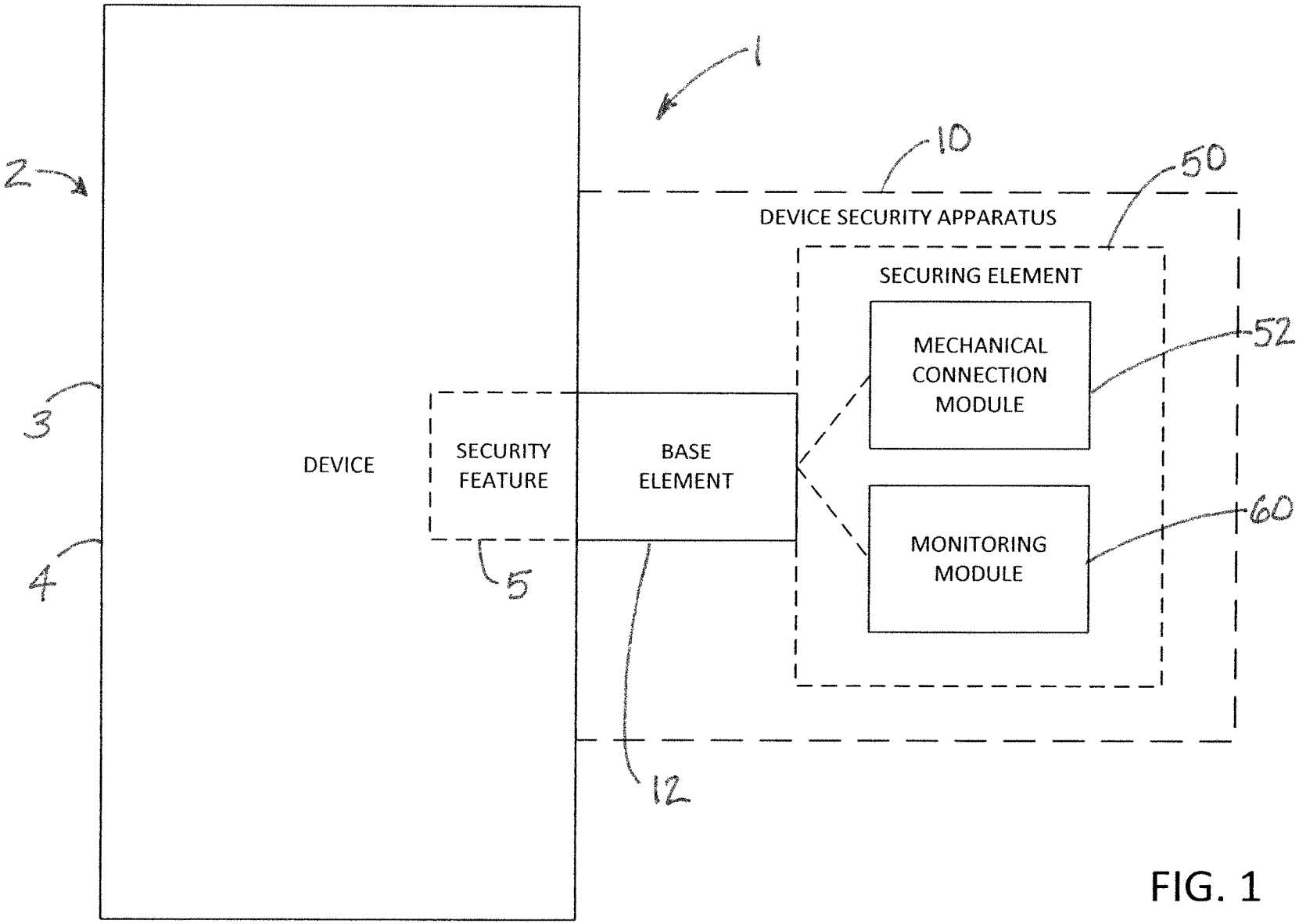
FIG. 1 is a schematic diagram of a system including a new apparatus for securing a device according to the present disclosure.
Figure 3:
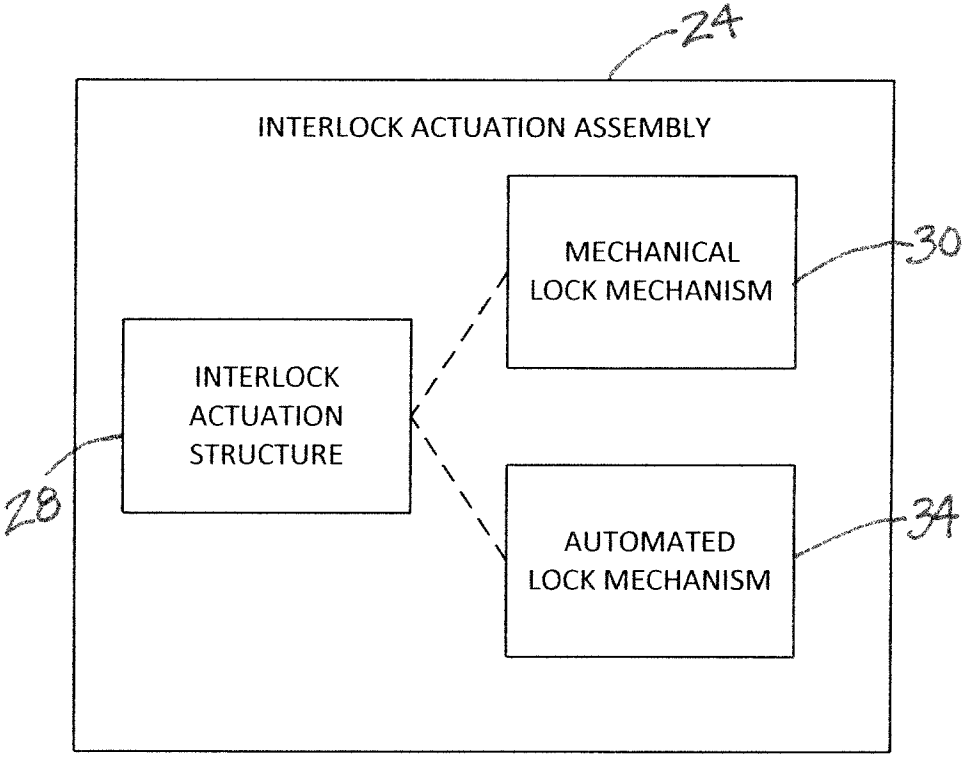
FIG. 3 is a schematic diagram of an interlock actuation assembly of the apparatus, according to an illustrative embodiment.
Figure 2:
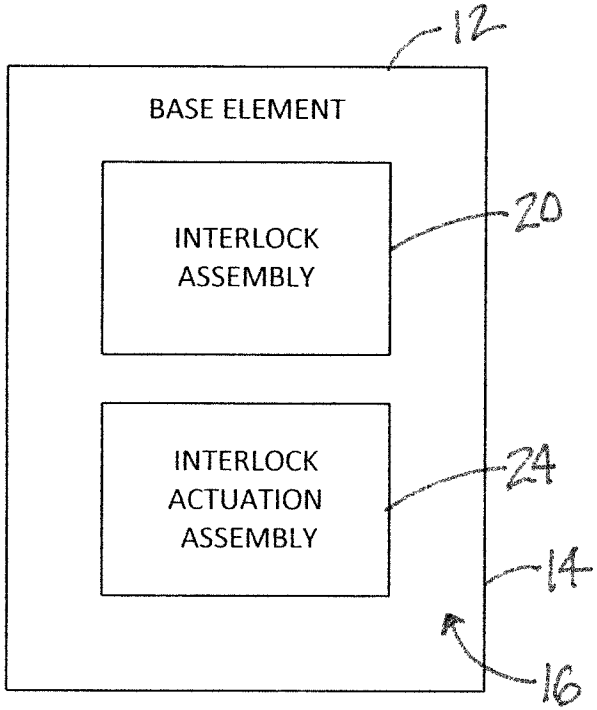
FIG. 2 is a schematic diagram of a base element of the apparatus, according to an illustrative embodiment.
Figure 5:
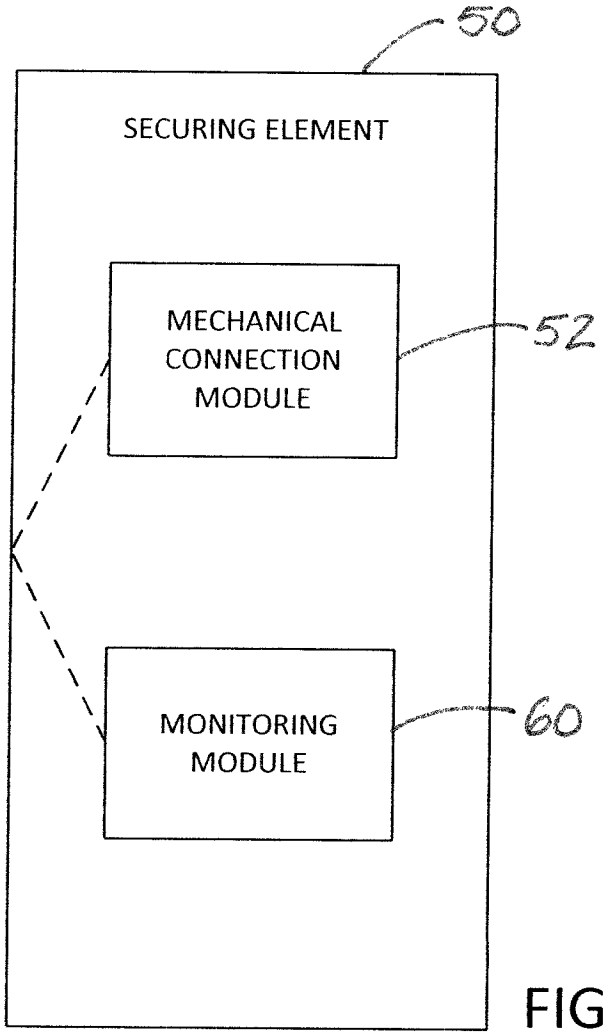
FIG. 5 is a schematic diagram of a securing assembly of the apparatus, according to an illustrative embodiment.
Figure 4:
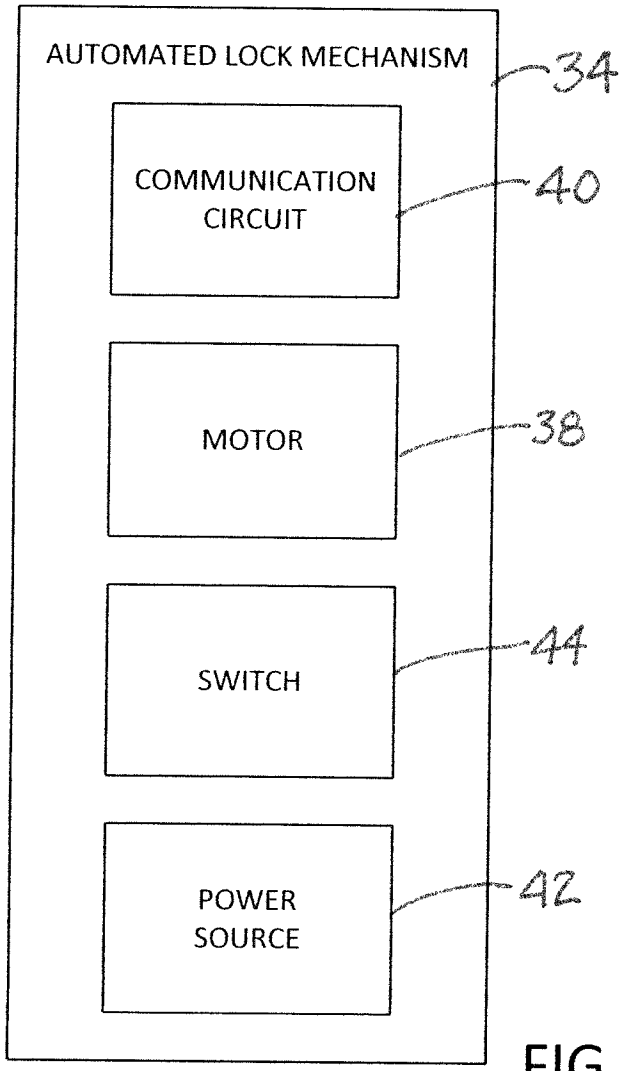
FIG. 4 is a schematic diagram of an automated lock mechanism of the apparatus, according to an illustrative embodiment.
Figure 6:
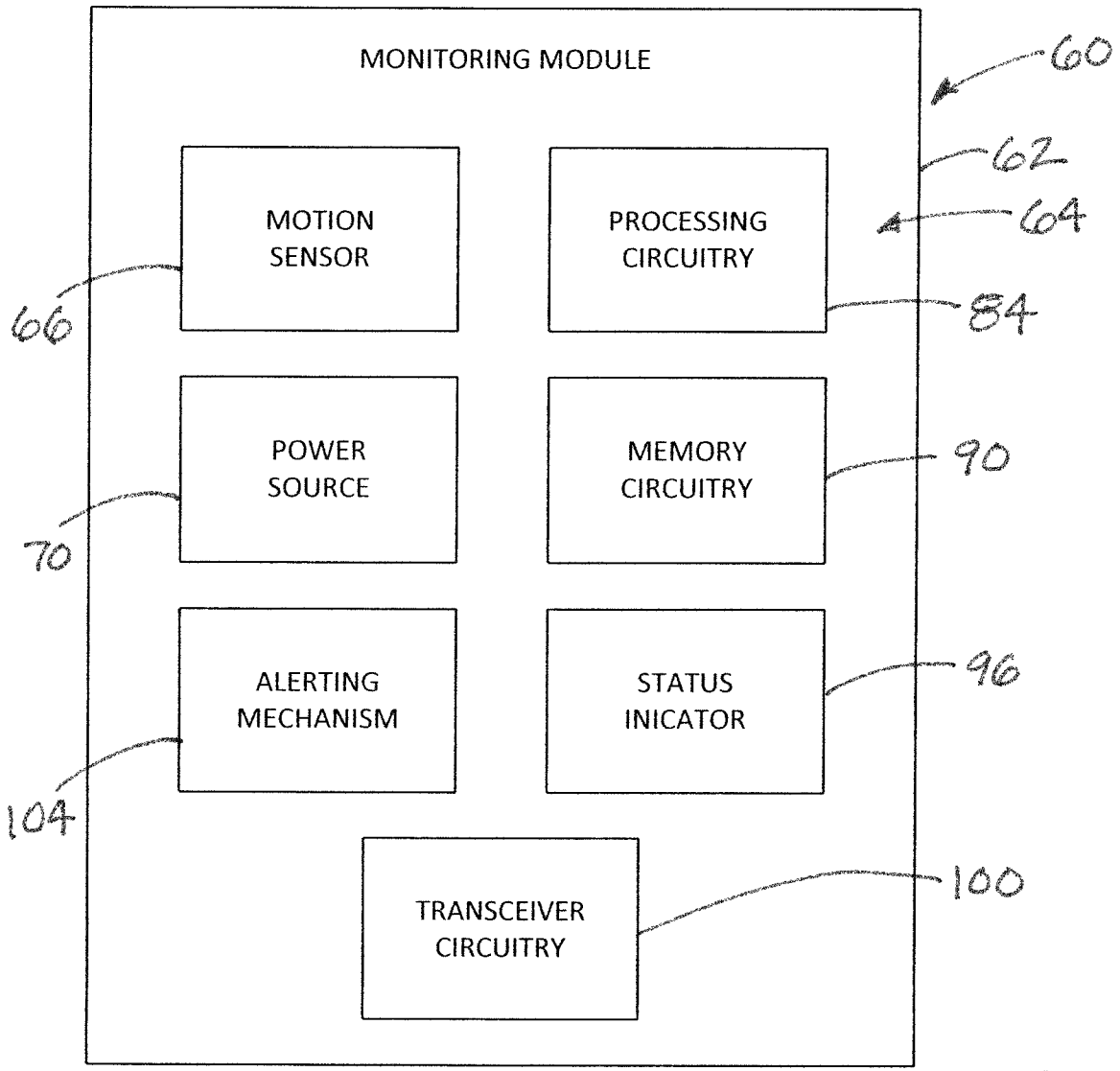
FIG. 6 is a schematic diagram of a monitoring module of the apparatus, according to an illustrative embodiment.
Figure 7:
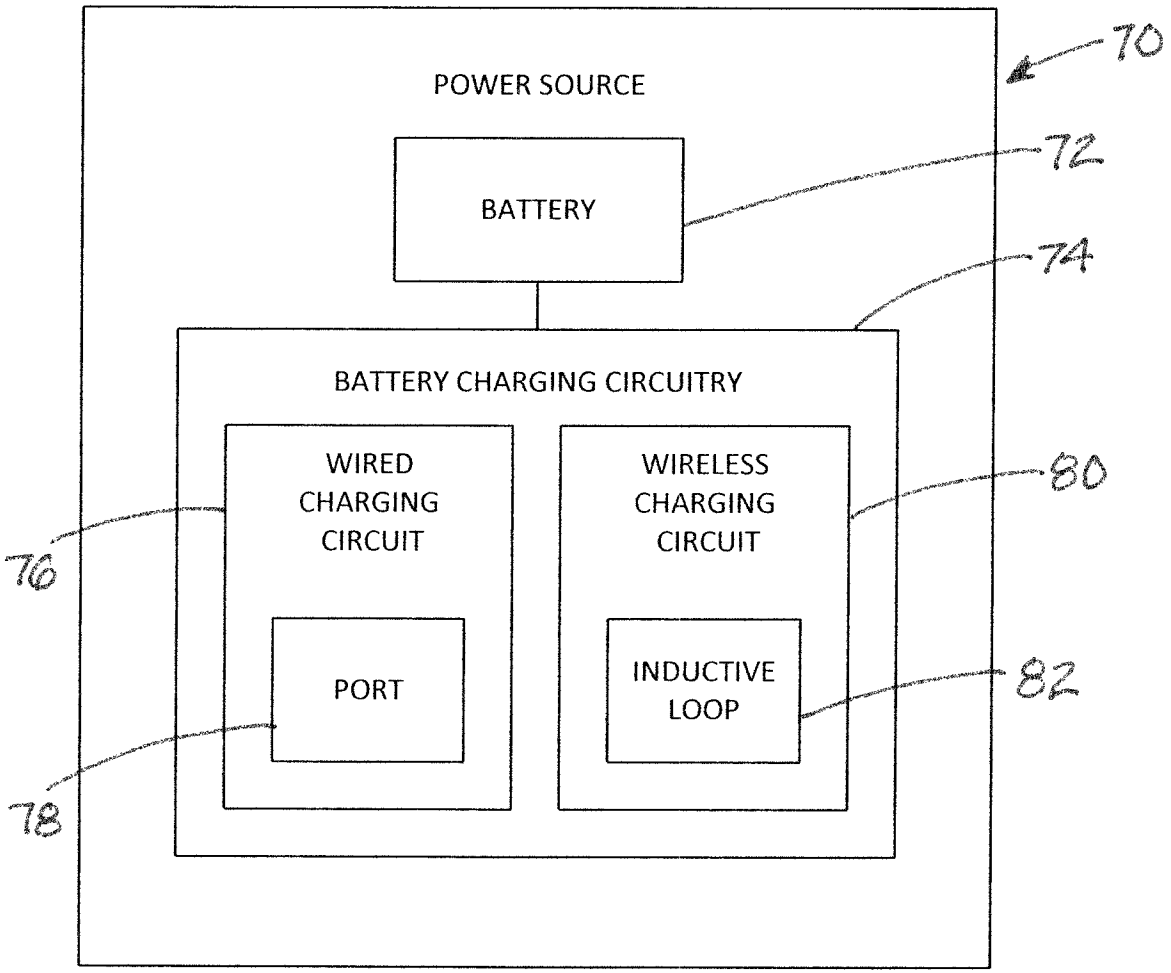
FIG. 7 is a schematic diagram of a power source of the monitoring module of the apparatus, according to an illustrative embodiment.

With reference now to the drawings, and in particular to FIGS. 1 through 7 thereof, a new apparatus for securing a device embodying the principles and concepts of the disclosed subject matter will be described.

The applicant has recognized that while existing security systems for high-value but easily portable devices can be effective, these systems have limitations and may lack versatility which would make them more useful in a variety of circumstances or environments. For example, security systems that tether a device to be protected to a larger and presumably immovable object are useful, but are markedly less useful when no such object exists proximate to the location where the device is desired to be used. Standardized structures incorporated into the devices for these systems have generally been limited to anchoring such tethering systems, but the applicant has recognized that the standardized structures can provide a convenient and effective basis for new security systems that do not require the device to be protected to be proximate to an object of immovable character. The applicant has also recognized that security systems relying upon physical connections can be physically compromised given the right tools and enough time, such as, for example, by severing the cable forming the tether.

The applicant has recognized that security systems capable of sensing or detecting movement of the portable device and providing a communication or alert corresponding to the sensing of device movement can be a highly useful function to alert a responsible person of unauthorized movement of the device as well as potentially providing a basis for tracking or following movement of the device during the unauthorized movement. In addition to notification of unauthorized movement, a perceptible alert or alerts may be emanated from the system that inform those proximate to the device that the device is the subject of unauthorized movement which may discourage unauthorized persons from tampering, or continuing to tamper, with the device. The attention of those persons proximate to the device may be drawn by an alarm sound emanating from the system, as well as other sonic or visual indicators.

In one aspect, the disclosure relates to a system 1 which generally may include a device 2, such as an easily portable device, and a device security apparatus 10 configured to provide security functionality for the device 2. Embodiments of the system 1 may include the device security apparatus 10 with and without the device 2.

In greater detail, the device 2 may have a case 3 which may encapsulate or enclose substantially an entirety of the elements of the device, and the case 3 may have an exterior surface 4. Illustratively, the device 2 may be an electronic device with computing and/or communications functionality, and may comprise a portable or laptop computer, a tablet computer, a computer peripheral or accessory, a personal digital assistant having telephonic capabilities such as a "smart phone." Other devices than those listed here may also benefit from the advantages of the disclosure.

The device 2 may have an integrated security feature 5 which may be integrally formed in the case 3 and may be accessible at the exterior surface 4 of the case. In some embodiments, the security feature comprises an aperture 6 extending through the exterior surface 4 of the case and into the case to some degree. In some highly preferred embodiments, the aperture 6 may have a predetermined configuration, such as a size and a shape (and a depth) to receive an engaging element of a predetermined configuration suitable for engaging an aperture of the size and shape and depth of the aperture in the case. Illustratively, the aperture 6 may have a configuration corresponding to that disclosed in U.S. Pat. No. 5,381,685 to Carl et al. which is hereby incorporated by reference in its entirety. More specifically, the security feature may correspond to the specifications set forth by Kensington Computer Products Group of ACCO Brands for the "Kensington security slot." It will be recognized that aspects of this disclosure may be useful for other security features on a device.

The device security apparatus 10 may be removably mountable on the device 2 to enhance the security to the device against, for example, unauthorized movement of the device when the apparatus is active. The device security apparatus 10 may be utilized to, for example, physically secure the device to a relatively immovable object or structure to resist or prevent unauthorized movement of the device away from the object. The device security apparatus 10 may also be utilized to secure the device 2 by monitoring movement of the device without physically securing the device to an object, such as by sensing movement of the device and communicating a notification of such movement to a user. Advantageously, the securing apparatus 10 may be removably mounted on the device 2 by utilizing the security feature 5 integrated into the device, such as the aperture 6 integrated into the case 3, which may be a common feature incorporated by the manufacturer of the device.

The device security apparatus 10 may have a plurality of operational modes which may include an armed mode and a disarmed mode. In the armed mode, for example, the apparatus 10 may be able to sense motion or movement of the device 2, and the sensing of motion or movement of the device by the apparatus may lead to further actions by the apparatus as disclosed herein (e.g., communicating notifications, emanating perceptible alerts or alarms). In the disarmed mode, some or all functionality of the apparatus 10 may be inoperative, such as sensing movement of the device 2 and taking further actions if movement of the device does occur. For the purposes of this disclosure, the terms "motion" and "movement" may include movement or disturbance of an element that does not necessarily cause a change of position or location (such as, for example, a change in orientation) and may also include movement of an element that does result in a change of position or location (even when not accompanied by a change in orientation).

The device security apparatus 10 may include a base element 12 which is configured to mount on the device 2, and may be removably mountable on the case 3 of the device, such as by releasably engaging the security feature 5 of the device. The base element 12 may include a primary housing 14 which may define an interior 16 in which structures of the base element 12 may be integrated or encapsulated in a secure manner resisting unauthorized tampering with the structures from the exterior of the base element.

The base element 12 may also include an interlock assembly 20 which is configured to selectively engage the device 2, and may engage a feature on the device such as the security feature 5 of the case 3 of the device. The interlock assembly 20 may have an interlock condition in which the interlock assembly of the base element 12 is engaged with the security feature on the case of the device, and is not removable from the case without significant noticeable damage to the case. The interlock assembly 20 may also have a released condition in which the interlock assembly is not engaged with the security feature, and is readily removable with respect to the device 2 and separated from the device.

The interlock assembly 20 may be mounted on the primary housing 14, and may at least partially be positioned in the interior 16 of the housing with a portion of the assembly 20 extending out of the housing to engage the security feature, such as the aperture 6. The interlock assembly 20 may have structure for engaging the security feature 5 that is compatible with the design of the aperture 6 and illustratively may have structure that is consistent with the aperture-engaging structure disclosed in U.S. Pat. No. 5,381,685 of Carl et al., although other configurations may be utilized.

The base element 12 may also include an interlock actuating assembly 24 which is configured to actuate the interlock assembly 20, such as moving the assembly 20 between the interlock condition and the released condition. The interlock actuation assembly 24 may be mounted on the primary housing 14, and may be positioned in the interior 16. In some embodiments, the interlock actuation assembly 24 may have a mechanical operational mode or configuration in which the interlock actuation assembly is operated using a mechanical object, such as a key, to actuate the interlock assembly between the interlock and released conditions. In some embodiments, the interlock actuation assembly 24 has an electrical or electronic operational mode or configuration in which the interlock actuation assembly is operated using electronic object, such as a device emanating wireless signals (e.g., a smartphone), to actuate the interlock assembly between the interlock and released conditions. It will be recognized that the interlock actuation assembly 24 may have only one, or both, of the operational modes or configurations.

The interlock actuation assembly 24 may include an interlock actuation structure 28 which is connected to the interlock assembly 20 in a manner capable of moving or changing the interlock assembly between the interlock and released conditions. The actuation assembly 24 may also include a mechanical lock mechanism 30 which is engaged with the interlock actuation structure 28 such that the mechanical lock mechanism is able to operate the actuation structure to operate the interlock assembly 20. The mechanical lock mechanism 30 may be operable by a mechanical object such as a key, and may include a lock cylinder which is operable by the key. Illustratively, the lock cylinder may include a pin tumbler, and the lock cylinder may be connected to the interlock actuation structure 28. The actuation assembly 24 may include an automated lock mechanism 34 which is engaged with the interlock actuation structure 28 to operate the interlock assembly 20. The automated lock mechanism 34 may be responsive to an unlock signal to cause the mechanism 34 to move the interlock assembly 20 to the interlock condition via the actuation structure 28, and may also be responsive to a lock signal to cause the mechanism 34 to move the interlock assembly 20 to the released condition via the structure 28. The automated lock mechanism 34 may include a motor 38 which is connected to the interlock actuation structure 28 such that operation of the motor in a first rotational direction causes the interlock actuation structure 28 to move the interlock assembly 20 to the interlock condition, and rotation of the motor in a second rotational direction causes the interlock actuation structure to move the interlock assembly to the release condition.

The base element 12 may also include a communication circuit 40 which is configured to wirelessly receive and send signals, such as the lock and unlock signals as well as status signals. The communication circuit 40 may communicate the received signals to the automated lock mechanism 34 to, for example, cause the motor 38 to operate. In some implementations, the signals to and/or from the communication circuit 40 may be encrypted to enhance security. Further, in some embodiments, the signals to and from the communication circuit may be transmitted via infrared (IR) wireless communications, although other wireless communication technologies may be utilized.

The base element 12 may also include a power source 42 which is configured to provide power to features of the element 12, such as the motor 38 and the communication circuit 40. The power source 42 may be in electrical communication with the motor and the communication circuit. The power source 42 may utilize a battery which may be removable and may be rechargeable. Optionally, the power source 42 may utilize other power-providing technologies, such as technologies which transfer power wirelessly through induction (employing, for example, near field communication (NFC). In some embodiments, a switch 44, such as in the form of a microswitch, may be provided to control the supply of power from the power source 42 to other electrical elements of the base element. The switch 44 may be positioned on the base element 12 in a manner such that engagement of the interlock assembly 20 of the base element with the security feature 6 of the device moves the switch to a closed condition which may provide power from the power source 42 to electrical elements of the base element 12 requiring power, and disengagement of the base element from the device moves the switch to an open condition which may interrupt the supply of power from the power source to electrical elements of the base element 12. Optionally, the switch 44 or other switch element may be operated wirelessly, such as through, for example, infrared (IR) or other suitable signals.

The device security apparatus 10 may also include a securing element 50 which is removably mounted on the base element 12, and may be mounted on the primary housing 14. The securing element 50 may include a plurality of modules which are configured to interchangeably mount on the primary housing of the base element, and each of the modules may have the same or similar mounting structures for cooperatively engaging the housing 14 of the base element. In some implementations, the mounting structures of the base element 12 and the modules may be configured to permit more than one module to be mounted on the base element simultaneously. The capability to simultaneously mount multiple modules to the base element may be provided by, for example, providing multiple mounting structures on the base element so that a module may be mounted on each of the mounting structures. Simultaneous mounting of multiple modules may also be provided by providing the modules with mounting structures that permit one module to be mounted on another module, so that a module may be mounted in a stacked or piggyback arrangement on another module which is mounted on the base element. Thus, the interchangeability of the modules does not necessarily require the use of only one module at a time with the base element, and the functionality and advantages of multiple different modules may be combined and utilized substantially simultaneously.

In some embodiments, the securing element 50 may include a mechanical connection module 52 which is configured to physically connect the device security apparatus 10 to an object. Illustratively, the mechanical connection module 52 may comprise a cable which is securable to or around an object to secure the base element 12, as well as any connected device 2, to the object. The mechanical connection module 52 may include an elongated member, such as a cable, which may be attached to the object such as by looping the cable about the object in order to physically secure the cable as well as the interconnected base element 12 and any device 2 which the base element is connected, to the object and hinder if not prevent movement of the device away from the object.

In some embodiments, the securing element 50 may include a monitoring module 60 which may be configured to operate at least during the armed mode of operation of the apparatus 10. The monitoring module 60 may include a module housing 62 which is mountable on the primary housing 14 of the base element 12, and the housing 62 may define a module interior 64. The module housing 62 may be formed in a manner that protects the other structures of the module 60 from unauthorized tampering or damage.

The monitoring module 60 may also include a motion sensor 66 which is configured to sense motion or movement of the monitoring module, and thereby sense motion or movement of connected structures such as the base element 12 and any device 2 connected to the base element 12. The motion sensor 66 may be positioned in the module interior 64. Sensed movement may include movement along the three perpendicular axes, and may include a number of types of movement, such as translational movement, rotational movement, vibrational movement, impact or shock movement, as well as other types of movement. The motion sensor 66 may sense, when active, movement of the module housing and structures interconnected with the module housing in a manner such that motion or movement of the interconnected structure causes motion or movement of the module housing in a manner that is detectable by the motion sensor. Such interconnection between the structure and the module housing may be a rigid connection, but flexible connections could also be employed if the interconnection is able to produce the same transfer of motion or movement between the structure and the module housing.

In some embodiments, the motion sensor 66 may detect physical motion, such as through the use of an accelerometer mounted on the module housing in a manner such that motion of the housing is transferred to the accelerometer, and the accelerometer produces a signal indicating that motion has been sensed or detected. In some embodiments, the motion sensor 66 may detect movement, or a change in location, of the motion sensor and thus the base element 12. Such detection of movement may be sufficiently sensitive to detect even relatively small changes in location, and may utilize a sensor 66 which is suitable for sensing such small movements. For example, devices employing position sensing (and change-of-position sensing) technologies, including Bluetooth Low Energy (BLE), Wi-Fi, Magnetic field detection, Near Field Communication (NFC), ultra-wideband, and the like may be utilized to detect movement and infer motion from the movement. In some further embodiments, a combination of a device or devices which detect physical motion and movement (e.g., change of location) may be utilized to provide a highly effective sensing of motion and movement of the base element 12.

The monitoring module 60 may also include a power source 70 for powering elements of the module 60, and may be mounted on the module housing and situated in the module interior. The power source 70 may comprise a battery 72 which may be of the rechargeable type and advantageously may be compact and have a relatively high energy storage capacity. One highly suitable power storage device is disclosed in U.S. Patent Application Publication No. 2014/0085773 of Chernukhin et al. which is hereby incorporated by reference in its entirety. Optionally, the power source 70 may utilize wireless power-providing technologies such as via induction.

The power source 70 of the monitoring module 60 may also include battery charging circuitry 74 which is configured to facilitate recharging of the battery 72. The battery charging circuitry 74 may be mounted on the module housing and positioned in the module interior. The battery charging circuitry 74 may include a wired charging circuit 76 which is configured to create a wired connection between the battery 72 and an external charging element, such as a power supply connected to the electrical circuits of a building or structure. The wired charging circuit 76 may include a port 78 which is mounted on the module housing 62, and the port may be in electrical communication with the battery 72 to permit electricity to be transferred through the charging port to the battery. Illustratively, the port 78 may comprise a selected format of a Universal Serial Bus (USB) connector jack.

The battery charging circuitry 74 of the power source 70 of the monitoring module 60 may also, or alternatively, include a wireless charging circuit 80 which is configured to create a wireless induction connection between the battery 72 and an external charging element. The wireless charging circuit may include an inductive coil 82 mounted on the module housing so as to be affected by electrical fields created adjacent to the module housing. The inductive coil 82 may be in electrical communication with the battery 72 to permit an electrical current induced in the coil 82 to be transferred to the battery for charging purposes.

The monitoring module 60 may also include processing circuitry 84 which is configured to operate elements of the monitoring module. The processing circuitry 84 may be in communication with the power source 70 and may be positioned in the module interior 64 of the housing 62. The module 60 may also include memory circuitry 90 which is in communication with the processing circuitry 84 for providing memory or storage to the processing circuitry. The memory circuitry 90 may be positioned in the module interior 64 as well.

The monitoring module 60 may also include a status indicator 96 which is configured to indicate a status of the monitoring module 60 or functionality performed by an element of the monitoring module. Illustratively, the status indicator 96 may be configured to indicate the status of the operational mode of the device security apparatus 10. For example, the status indicator 96 may have an armed condition indicating the device security apparatus is in the armed mode, and illustratively may include constant illumination of a light source forming the status indicator 96. Further, the status indicator may have an unarmed condition indicating the device security apparatus is in the unarmed mode, and illustratively may include extinguishment of any illumination of the light source forming the status indicator.

The monitoring module 60 may also include transceiver circuitry 100 which is configured to communicate data, such as commands and status information, to and from the monitoring module. The transceiver circuitry 100 may permit communication between elements of the monitoring module and an information handling device, such as a computing device or a communications device including a cellular telephone with computing capabilities (smart phone). The transceiver circuitry 100 may be configured to communicate using any suitable wireless technology, such as, for example in infrared (IR) signal which may optionally be generated by a light-emitting diode (LED). Communications between the transceiver circuitry 100 may occur with, for example, the device 2 or another device having computing and/or communication capabilities such as a smartphone.

The monitoring module 60 may also include an alerting mechanism 104 which is configured to produce an alert which is perceptible to the senses of a person in proximity to the module 60, such as an audible alert with a sound, a visual alert with a light, a tactile alert with the vibration of structures of the module 60, and the like.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A system for securing a device having a case and a security feature integrated into the device, the system comprising:

a device security apparatus removably mountable on the device by means of the security feature on the case of the device, the device security apparatus comprising:

a base element configured to mount on the device by releasably engaging the security feature of the device; and a securing element mounted on the base element, the securing element including at least one of a plurality of modules configured to interchangeably mount on the base element, the plurality of modules including:

a mechanical connection module configured to physically connect the device security apparatus to an object; and a monitoring module configured to monitor movement of the device security apparatus and any device connected to the device security apparatus.

2. The system of claim 1 wherein the securing element of the device security apparatus includes both the mechanical connection module and the monitoring module simultaneously connected to the base element.

3. The system of claim 1 wherein the device security apparatus has a plurality of operational modes including an armed mode and a disarmed mode.

4. The system of claim 1 wherein the security feature of the device comprises an aperture formed in the case of the device, and the base element is configured to interlock with the aperture in the case to produce the releasable engagement of the device securing apparatus with the security feature of the device.

5. The system of claim 1 wherein the base element of the device security apparatus includes:

a primary housing defining an interior;

an interlock assembly mounted on the primary housing and configured to selectively engage with the security feature of the device, the interlock assembly having an interlock condition and a released condition; and an interlock actuation assembly mounted on the primary housing and configured to actuate the interlock assembly between the interlock and released conditions.

6. The system of claim 5 wherein the device security apparatus has a plurality of operational modes including an armed mode and a disarmed mode; and wherein the device security apparatus enters the armed mode when the interlock assembly is changed to the interlock condition and the device security apparatus enters the disarmed mode when the interlock assembly is changed to the released condition.

7. The system of claim 5 wherein the interlock actuation assembly has a mechanical operational mode in which the interlock actuation assembly is operated using a mechanical object to actuate the interlock assembly between the interlock and released conditions.

8. The system of claim 5 wherein the interlock actuation assembly has an electronic operational mode in which the interlock actuation assembly is operated using an electronic object to actuate the interlock assembly between the interlock and released conditions.

9. The system of claim 5 wherein the interlock actuation assembly has:

a mechanical operational mode in which the interlock actuation assembly is operated using a mechanical object to actuate the interlock assembly between the interlock and released conditions; and an electronic operational mode in which the interlock actuation assembly is operated using an electronic object to actuate the interlock assembly between the interlock and released conditions.

10. The system of claim 5 wherein the interlock actuation assembly comprises:

an interlock actuation structure connected to the interlock assembly in a manner configured to move the interlock assembly between the interlock and released conditions; and a mechanical lock mechanism engaged with the interlock actuation structure and being configured to be actuated by a mechanical object.

11. The system of claim 10 wherein the interlock actuation assembly additionally includes:

an automated lock mechanism engaged with the interlock actuation structure, the automated lock mechanism being configured to be responsive to an unlock signal and a lock signal.

12. The system of claim 11 wherein the automated lock mechanism includes:

a motor connected to the interlock actuation structure such that operation of the motor in a first rotational direction causes the interlock actuation structure to move the interlock assembly to the interlock condition and rotation of the motor in a second rotational direction causes the interlock actuation structure to move the interlock assembly to the released condition; and a communication circuit configured to wirelessly receive the lock and unlock signals to cause operation of the motor in the first and second rotational directions based upon the signals received by the communication circuit.

13. The system of claim 5 wherein the monitoring module includes:

a module housing mountable on the primary housing of the base element; and a motion sensor configured to sense motion of the module housing.

14. The system of claim 13 wherein the monitoring module including a power source for powering elements of the monitoring module, the power source including a rechargeable battery.

15. The system of claim 14 wherein the power source includes battery charging circuitry configured to facilitate recharging of the battery.

16. The system of claim 15 wherein the battery charging circuitry includes a wired charging circuit configured to create a wired connection between the battery and an external charging element.

17. The system of claim 15 wherein the battery charging circuitry includes a wireless charging circuit configured to create a wireless induction connection between the battery and an external charging element.

18. The system of claim 5 wherein the monitoring module includes a status indicator configured to indicate a status of the operational mode of the device security apparatus, the status indicator having an armed condition indicating the device security apparatus is in an armed mode and an unarmed condition indicating that the device security apparatus is in an unarmed mode.

19. The system of claim 5 wherein the monitoring module includes transceiver circuitry configured to communicate commands and status information to and from the monitoring module.

* * * * *